US008053695B2

(12) United States Patent
Sohn

(10) Patent No.: US 8,053,695 B2
(45) Date of Patent: Nov. 8, 2011

(54) TIME DELAY OUTPUT APPARATUS FOR CIRCUIT BREAKER

(75) Inventor: Jong-Mahn Sohn, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 803 days.

(21) Appl. No.: 12/163,002

(22) Filed: Jun. 27, 2008

(65) Prior Publication Data

US 2009/0014301 A1 Jan. 15, 2009

(30) Foreign Application Priority Data

Jul. 12, 2007 (KR) ..... 10-2007-0070278

(51) Int. Cl.
*H01H 13/00* (2006.01)
*H01H 13/14* (2006.01)
*H01H 9/20* (2006.01)

(52) U.S. Cl. ..... 200/334; 200/33 R

(58) Field of Classification Search ..... 200/334
See application file for complete search history.

(56) References Cited

U.S. PATENT DOCUMENTS

| | | | | |
|---|---|---|---|---|
| 4,639,561 | A | 1/1987 | Manlandi | |
| 6,864,450 | B1 * | 3/2005 | Chen et al. | 200/400 |
| 2008/0087534 | A1 | 4/2008 | Yang et al. | |
| 2008/0088395 | A1 | 4/2008 | Seo | |
| 2008/0088396 | A1 | 4/2008 | Ahn et al. | |
| 2008/0122563 | A1 | 5/2008 | Song | |
| 2008/0157906 | A1 | 7/2008 | Oh | |

FOREIGN PATENT DOCUMENTS

| | | |
|---|---|---|
| JP | 56-120625 | 9/1981 |
| JP | 59-136137 | 9/1984 |
| JP | 8-96670 | 4/1996 |
| JP | 9-320421 | 12/1997 |
| JP | 2000-209719 | 7/2000 |
| KR | 2005006638 | 1/2005 |
| RU | 94039034 | 8/1996 |
| SU | 531214 | 10/1976 |
| SU | 752548 | 7/1980 |
| SU | 907629 | 2/1982 |

OTHER PUBLICATIONS

U.S. Appl. No. 12/144,793 to Lyu, which was filed on Jun. 24, 2008.
U.S. Appl. No. 12/146,702 to Park, which was filed on Jun. 26, 2008.
U.S. Appl. No. 12/147,698 to Yang, which was filed on Jun. 27, 2008.
U.S. Appl. No. 12/164,296 to Ahn, which was filed on Jun. 30, 2008.
U.S. Appl. No. 12/164,691 to Ahn, which was filed on Jun. 30, 2008.
U.S. Appl. No. 12/165,789 to Kim et al., which was filed on Jul. 1, 2008.
Japan Office action, mail date is Jan. 25, 2011.

* cited by examiner

*Primary Examiner* — Renee Luebke
*Assistant Examiner* — Lheiren Mae Caroc
(74) *Attorney, Agent, or Firm* — Greenblum & Bernstein, P.L.C.

(57) ABSTRACT

A time delay output apparatus for a circuit breaker includes a switch disposed at one side of a main shaft rotatable in directions to open/close a fixed contactor and a movable contactor, and a delay member disposed between the main shaft and the switch so as to operate the switch with a preset time delay, thereby simplifying the construction and reducing the size as well as enhancing operational reliability by stably obtaining a time delay.

17 Claims, 4 Drawing Sheets

TIME DELAY OUTPUT APPARATUS FOR CIRCUIT BREAKER

RELATED APPLICATION

The present disclosure relates to subject matter contained in priority Korean Application No. 10-2007-0070278, filed on Jul. 12, 2007, which is herein expressly incorporated by reference in its entirety.

BACKGROUND OF THE INVENTION

1. Field of the Invention

The present invention relates to a time delay output apparatus for a circuit breaker, and more particularly, to a time delay output apparatus for a circuit breaker which is capable of preventing a malfunction caused by vibration, by excluding the use of a mass, thereby enhancing the operational reliability.

2. Description of the Background Art

In general, a circuit breaker is an protective electrical device disposed between a power source and a load equipment so as to protect the load equipment and an electrical line from a circuit fault (e.g., a large current due to a short circuit, earth fault, etc.) which may occur in an electrical circuit.

Some circuit breakers are provided with a relay performing an MCR (Making Current Release) function, which sets a current value, detects the introduced current, and instantaneously opens the circuit breaker when a large current greater than a reference value is introduced, thus to prevent the flow of the large current into the load side.

The relay blocks the electrical line within a preset allowable delay time. When the circuit breaker is closed to check whether or not a fault occurred in the electrical line, and if the fault is not completely solved, a large fault current flows for the preset allowable time in the electrical line, thereby causing damage in the electrical line and the load. When the circuit breaker is closed to check whether or not a fault occurred in the electrical line, and if a main contact is contacted and thus a fault current is detected, there is a need to instantaneously open the circuit breaker without maintaining the allowable (delay) time preset on the relay in order to reduce damage in the electrical line and the load. Such function is called the "MCR" function.

In order for the relay to perform the MCR function, two cases should be distinguished: one case is where the fault current is blocked (i.e., a fixed contactor and a movable contactor are separated) when the circuit breaker is closed, and another case is where the fault current is blocked (i.e., the fixed contactor and the movable contactor contact each other) when the circuit breaker is closed on an electrical line where the circuit breaker had been opened due to a previously occurred fault. In order to distinguish such two cases, there is provided a time delay output apparatus for a circuit breaker, which outputs a contact signal with a certain delay time after the fixed contactor and the movable contactor contact each other.

As shown in FIGS. 1 and 2, the time delay output apparatus for a circuit breaker includes a switch 20 disposed at one side of a main shaft 10 so as to output a signal when a contact is detected, a delay plate 30 disposed pivotably with respect to a detection portion of the switch 20 so as to contact and be separated from the detection portion of the switch 20, and a lever 12 integrally formed with the main shaft 10, and pressing and pivoting the delay plate 30 so as to be separated from the switch 20 when the main shaft 10 is rotated in an opening direction.

The delay plate 30 includes a pivot shaft 31, a first arm 33 extending from the pivot shaft 31 to the main shaft 10 and contacting the lever 12, and a second arm 35 extending from the pivot shaft 31 to the switch 20 and contacting the detection portion of the switch 20 by being pivoted together with the first arm 33. A spring 37 is connected to the second arm 35 so as to apply an elastic force in a direction urging the second arm 35 to contact the switch 20.

Meanwhile, the second arm 35 is provided with a mass 39 for generating a certain time delay by inertia when the main shaft 10 is rotated in a closing direction.

With such construction, when the circuit breaker is opened, as shown in FIG. 1, the lever 12 presses the delay plate 30, and thus the delay plate 30 is spaced apart from the switch 20. When the main shaft 10 is rotated in a closing direction (i.e., in a counter-clockwise direction in the drawing), the delay plate 30 is pivoted toward the switch 20 in a clockwise direction in the drawing by the urging force of the spring 37. Here, while the delay plate 30 is pivoted, a certain delay is generated by inertia of the mass 39. Such delay serves to output a signal from the switch 20 once the delay plate 30 contacts the detection portion of the switch 20 after the fixed contactor and the movable contactor contact each other by the rotation of the main shaft 10.

However, in this conventional time delay output apparatus for a circuit breaker, a relatively large mass 39 is required to generate a certain (fixed) delay, thereby increasing the size of the time delay output apparatus.

In addition, when a large current is introduced, the inertia when the mass 39 is vibrated or moved by vibration generated by electromagnetic repulsion force becomes more reduced, compared to that of when the mass 39 is stopped. Accordingly, the delay plate 30 cannot maintain the preset delay. Consequently, the switch 20 outputs a signal too early, and the circuit breaker is instantaneously opened, thereby not performing its function properly.

SUMMARY OF THE INVENTION

Therefore, it is an object of the present invention to provide a time delay output apparatus for a circuit breaker, which can simplify its construction and reduce its size.

It is another object of the present invention to provide a time delay output apparatus for a circuit breaker which can enhance its operational reliability by stably obtaining a time delay.

To achieve these and other objects and advantages and in accordance with the purpose of the present invention, as embodied and broadly described herein, there is provided a time delay output apparatus for a circuit breaker, including: a switch disposed at one side of a main shaft rotating in a direction to open/close a fixed contactor and a movable contactor; and a delay member disposed between the main shaft and the switch so as to operate the switch with a preset time delay.

Here, there is further provided a reset plate disposed to be separated from the delay member and to interwork with the main shaft so as to generate a time delay, thus to transfer a driving force of the main shaft to the delay member.

The reset plate can be configured to rotate centering around a pivot shaft disposed parallel to the main shaft.

There is further provided a delay member spring urging the delay member into contact with the switch.

The delay member include a pivot shaft, a first contact portion extending from one end of the pivot shaft and contacting the switch, and a second contact portion extending from another end of the pivot shaft.

There is further provided a stopper for restricting a pivoting movement of the delay member in a direction to separate the delay member from the switch.

The delay member spring may be formed as a coiled tension spring.

The delay member spring may have a dead point between the stopper and the switch when the delay member is pivoted.

The delay member may function so as to operate the switch after the fixed contactor and the movable contactor contact each other.

There is further provided a driving arm disposed protrudingly in a radial direction at the main shaft so as to contact the reset plate.

There is further provided a reset plate spring for applying an elastic force urging the reset plate into contact with the driving arm.

A bent end portion bent so as to contact the delay member is formed at the reset plate.

When the main shaft is rotated to a trip position, the reset plate presses the second contact portion and then the delay member is pivoted, and when the main shaft is rotated in a direction to contact the fixed contactor and the movable contactor with each other, the reset plate presses the first contact portion and thereby the delay member is pivoted.

The bent end portion contacts the delay member and restricts the pivoting movement of the delay member when the delay member is suddenly rotated.

In the state that the bent end portion and the delay member contact each other, when the main shaft is rotated at the time of closing operation, the bent end portion presses the second contact portion and the reset plate is pivoted in a direction to separate the delay member from the switch, and the reset plate presses the second contact portion such that the second contact portion contacts the switch.

According to another aspect of the present invention, there is provided a time delay output apparatus for a circuit breaker, including: a switch disposed at one side of a main shaft rotatable in directions to open/close a fixed contactor and a movable contactor; a delay member disposed between the main shaft and the switch so as to operate the switch with a preset time delay; and a delay member spring for urging the delay member into contact with the switch.

According to still another aspect of the present invention, there is provided a time delay output apparatus for a circuit breaker, including: a switch disposed at one side of a main shaft rotatable in directions to open/close a fixed contactor and a movable contactor; a delay member disposed between the main shaft and the switch so as to operate the switch with a preset time delay; a delay member spring for applying an elastic force urging the delay member to contact with the switch; and a reset plate disposed to be separated from the delay member and to interwork with the main shaft so as to generate the time delay, thus to transfer a driving force of the main shaft to the delay member.

Here, the reset plate is rotatable centering around a pivot shaft disposed parallel to the main shaft.

There is further provided a reset plate spring for applying an elastic force to the reset plate such that the reset plate is urged into contact with the main shaft.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the time delay output apparatus for a circuit breaker according to one embodiment of the present invention, examples of which are illustrated in the accompanying drawings.

Figure 1:
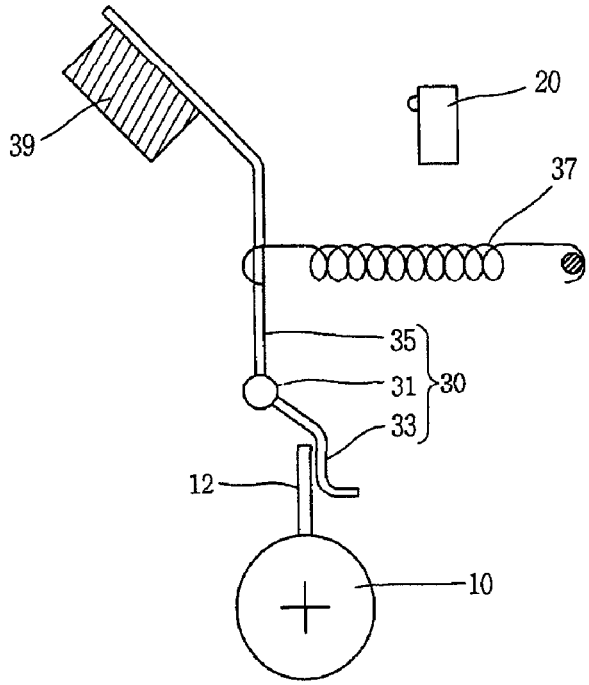
FIG. 1 RELATED ART
FIG. 1 is a view illustrating a conventional time delay output apparatus for a circuit breaker.
Figure 2:
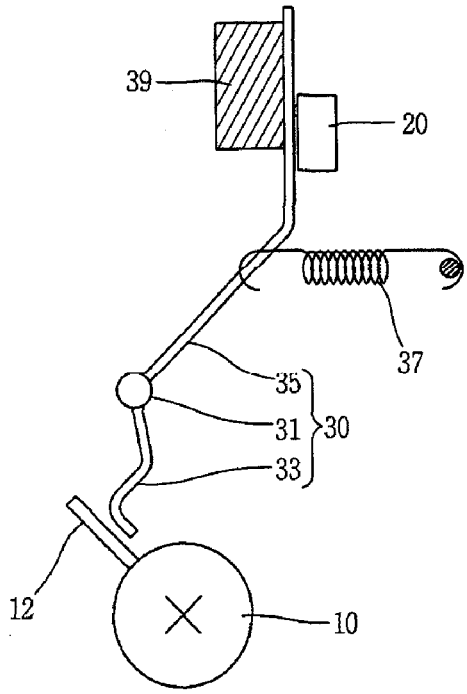
FIG. 2 RELATED ART
FIG. 2 is a view illustrating a state that the time delay output apparatus for a circuit breaker in FIG. 1 outputs a signal.
Figure 3:
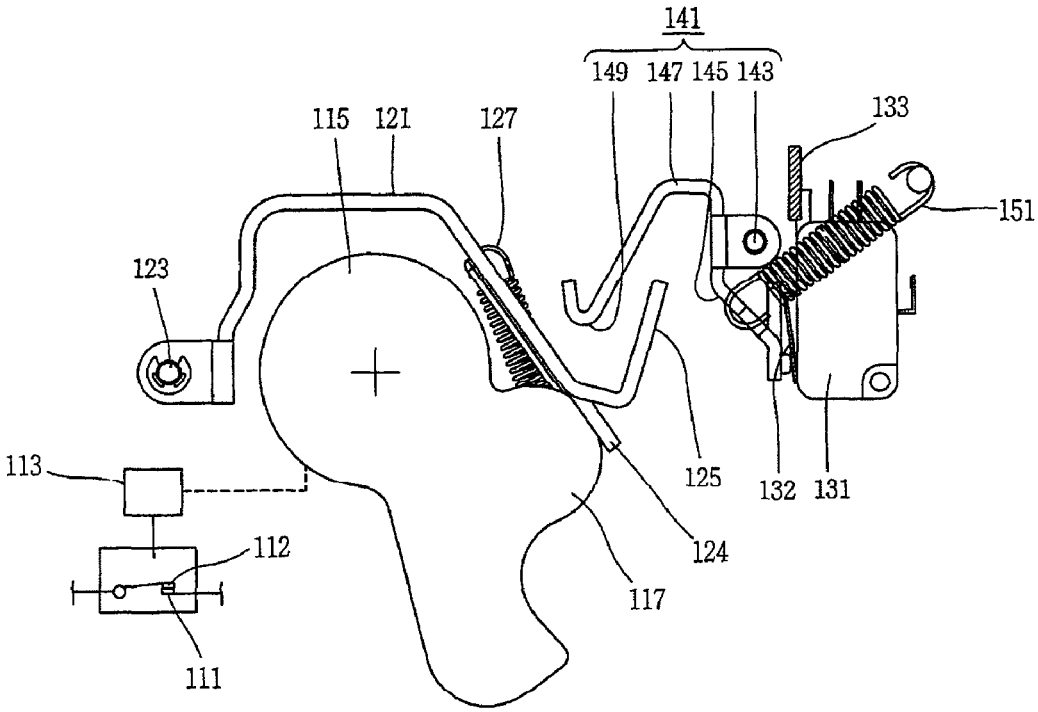
FIG. 3 is a side view illustrating a time delay output apparatus for a circuit breaker according to one embodiment of the present invention.
Figure 4:
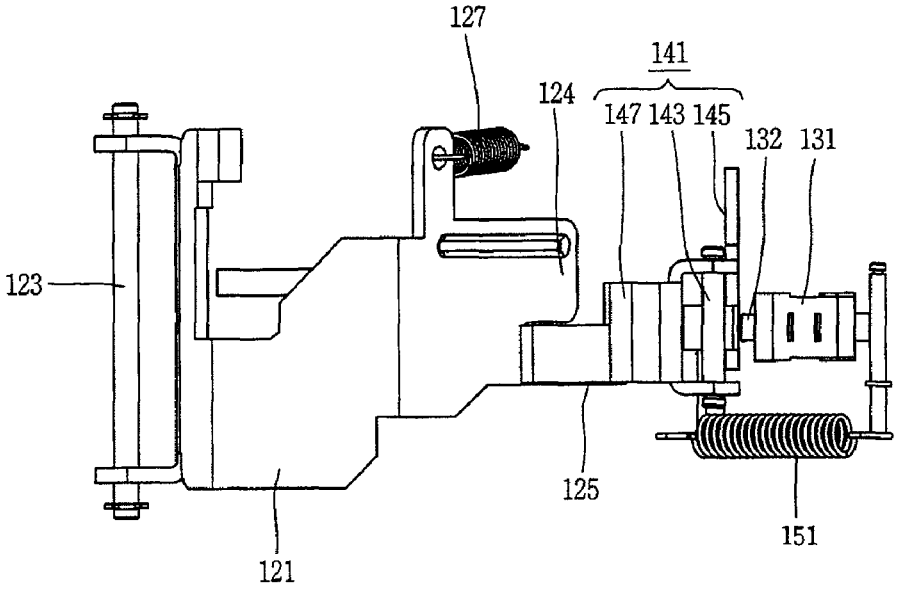
FIG. 4 is a top view of the time delay output apparatus for a circuit breaker in FIG. 3.

Referring to FIGS. 3 and 4, the time delay output apparatus for a circuit breaker according to the present invention may utilize a signal generating device such as a switch 131 disposed to one side of a main shaft 115 which is rotatable in respective directions to open or close a fixed contactor 111 and a movable contactor 112; and a delay member 141 disposed between the main shaft 115 and the switch 131 so as to be pivoted by interworking with a rotation of the main shaft 115, and for operating the switch 131 with a preset time delay after the fixed contactor 111 and the movable contactor 112 contact each other.

A contact switching mechanism 113 for opening/closing the fixed contactor 111 and the movable contactor 112 is connected with the main shaft 115. And, a driving arm 117 is protrudingly disposed in a radial direction at the main shaft 115. A reset plate 121 is disposed to one side of the driving arm 117 so as to be pivoted by interworking with the main shaft 115 when the main shaft 115 is pivoted. The reset plate 121 is pivotably coupled to one side of the main shaft 115 centering around a pivot shaft 123 disposed parallel to the main shaft 115.

When an overcurrent relay (not shown) outputs a trip signal, the reset plate 121 may perform a function of returning an actuator (not shown) to its original position, while performing a pivoting movement by interworking with the rotation of the main shaft 115. Here, the actuator generates a physical trigger signal such that the switching mechanism 113 may perform an opening operation for separating the fixed contactor 111 and the movable contactor 112 from each other.

The reset plate 121 is provided with a driving arm contact portion 124 having a curved cross-sectional shape so as to receive one region of the main shaft 115 therein and contacting the driving arm 117 at one end thereof farther away from the pivot shaft 123. A bent end portion 125 bent so as to contact the delay member 141 is formed to one side of the driving arm contact portion 124. At one side of the reset plate 121 is connected a reset plate spring 127 for applying an elastic force in a direction such that the driving arm contact portion 124 of the reset plate 121 is urged into contact with the main shaft 115.

Meanwhile, at one side of the main shaft 115 is disposed the switch 131 for outputting a contact signal by interworking with the main shaft 115 when the main shaft 115 is rotated in a closing direction (i.e., in a direction to contact the fixed contactor 111 and the movable contactor 112 with each other). At one side of the switch 131 (i.e., at the upper area as shown in the drawing) is disposed a stopper 133 for stopping the delay member 141 from being pivoted beyond a certain angle in a direction away from the switch 131. Here, the stopper 133 may be integrally formed at an upper area of a case of the switch 131.

The delay member 141 for being pivoted by interworking with the rotation of the main shaft 115 is disposed at one side of the switch 131 (i.e., at the left side as shown in the drawing). The delay member 141 is provided with a pivot shaft 143 disposed parallel to the main shaft 115, a first contact portion 145 extending from the pivot shaft 143 to one side and pivotable for contacting the switch 131, and a second contact portion 147 extending from the pivot shaft 143 to another side and pivoting together with the first contact portion 145.

A delay member spring 151 for applying an elastic force so as to urge the first contact portion 145 of delay member 141 into contact with the switch 131 is connected to one part of the delay member 141 (e.g., the first contact portion 145). The delay member spring 151 may be implemented as a coiled tension spring. One end of the delay member spring 151 is connected to the first contact portion 145 so as to form a dead point (dead zone) between the switch 131 and the stopper 133 in a pivot direction of the delay member 141. This is to exert an elastic urging force from the delay member spring 151, when the main shaft 115 is at the closing position, the delay member 141 is pivoted in a direction to contact the switch 131, and when the main shaft 115 is at the opening position, the delay member 141 is pivoted in a direction to be spaced apart from the switch 131.

The second contact portion 147 is provided with a rounded portion 149 implemented as an outer surface of the second contact portion 147 being curved, thereby smoothly contacting the bent end portion 125 of the reset plate 121 when the main shaft 115 is pivoted in the opening direction. Here, the bent end portion 125 is disposed inclined with respect to the delay member 141. This is to prevent a further pivoting movement of the delay member 125 toward the switch 131 since the bent end portion 125 contacts the rounded portion 149 when the delay member 141 is pivoted by an external force in a direction to approach the switch 131 via the dead point of the delay member spring 151, and the like. In addition, the bent end portion 125 is disposed inclined with respect to the delay member 141. When the main shaft 115 is pivoted to a closing position, the bent end portion 125 contacts the rounded portion 149, and the delay member 141 is pivoted in a direction to separate from the switch 131 so as to pass the dead point of the delay member spring 151, thereby always uniformly maintaining a preset time delay.

With such configuration, when the main shaft 115 is rotated to a closing position, as shown in FIG. 3, the first contact portion 145 of the delay member 141 contacts a detection portion 132 of the switch 131 due to an elastic urging force of the delay member spring 151. Accordingly, the switch 131 outputs a signal based on the contact state.

Figure 5:
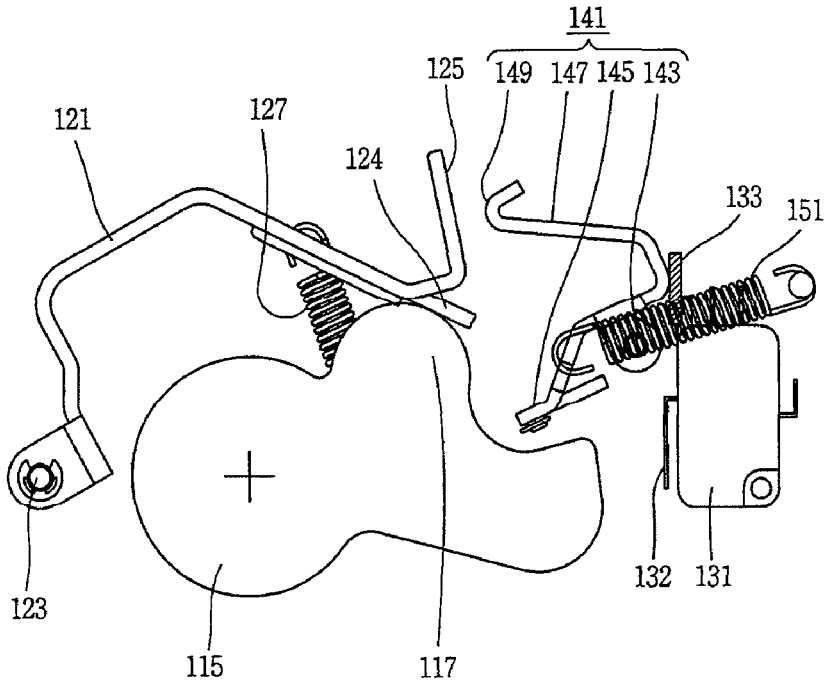
FIGS. 5 through 7 are views respectively illustrating the operation of the time delay output apparatus for a circuit breaker in FIG. 3.

As shown in FIG. 5, when the main shaft 115 is rotated to an opening position, the reset plate 121 is pressed by the driving arm 117, thereby pivoting in a counter-clockwise direction in the drawing. Here, the bent end portion 125 presses the second contact portion 147 of the delay member 141, and is then pivoted in the direction to separate the first contact portion 145 from the switch 131 (i.e., in a clockwise direction in the drawing). If the delay member spring 151 passes the dead point as the delay member 141 is pivoted, the elastic urging force of the delay member spring 151 serves to pivot the delay member 141 in a clockwise direction. Here, the pivoting movement of the delay member 141 is restricted by the stopper 133, and thus the first contact portion 145 of the delay member 141 is spaced apart from the switch 131.

If the main shaft 115 is rotated in a closing direction (i.e., in a clockwise direction in the drawing), the reset plate 121 is pivoted in a clockwise direction in the drawing by the elastic urging force of the reset plate spring 127. Here, since the first contact portion 145 of the delay member 141 is spaced apart from the bent end portion 125 of the reset plate 121 by a certain distance, the bent end portion 125 presses upon the first contact portion 145 after a certain period of time. Accordingly, after the fixed contactor 111 and the movable contactor 112 contact each other, the switch 131 may always output a signal to the outside when the preset time delay has elapsed.

Figure 6:
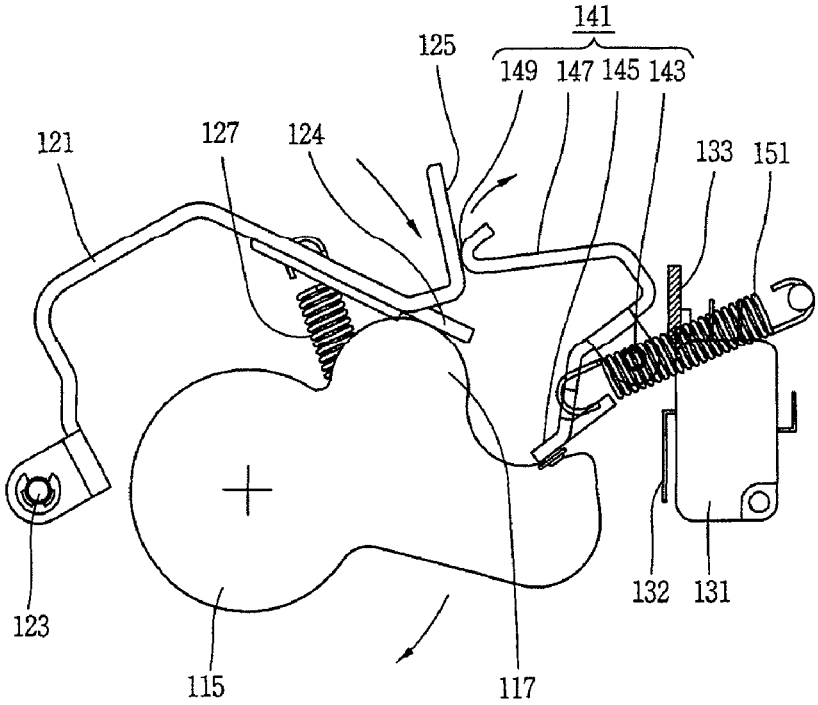

Meanwhile, when the delay member 141 is pivoted by an external force, etc. in a direction so as for the first contact portion 145 to approach the switch 131, as shown in FIG. 6, the pivoting movement of the delay member 141 is restricted as the rounded portion 149 contacts the bent end portion 125. Here, although it may appears in the drawing that the driving arm 117 and the delay member 141 contact each other, they are actually spaced apart from each other along the axial direction of the main shaft 115, thereby not contacting each other.

In the state that the delay member 141 is pivoted via the dead point and contacts the bent end portion 125, when the main shaft 115 is rotated to a closing position, the reset plate 121 is rotated (in a clockwise direction in the drawing) by the elastic urging force of the reset plate spring 127. The bent end portion 125 of the reset plate 121 upwardly (in the drawing) presses upon the rounded portion 149 of the second contact portion 147 such that the delay member 141 is pivoted in a direction so as to separate the first contact portion 145 from the switch 131 so as to pass the dead point. The delay member 141 is pivoted in a direction to space the first contact portion 145 apart from the switch 131 by the elastic urging force of the delay member spring 151, and is then stopped from pivoting further by the stopper 133, thereby being separated from the switch 131.

Figure 7:
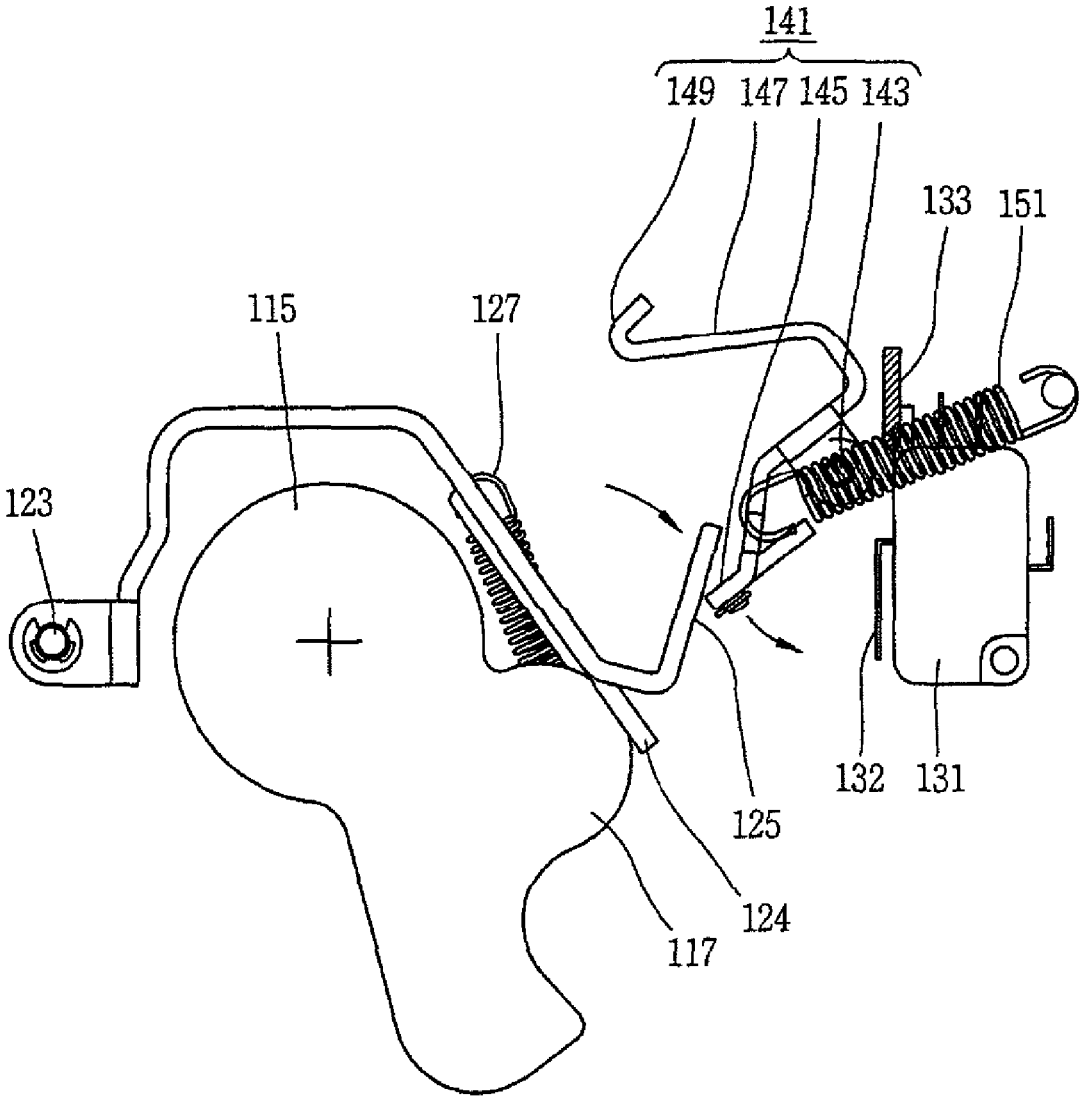

As shown in FIG. 7, the bent end portion 125 having pivoted past the rounded portion 149 then presses upon the first contact portion 145, thereby pivoting the delay member 141 toward the switch 131. When the delay member 141 passes the dead point of the delay member spring 151 while being pivoted, the delay member 141 then continues to pivot under the elastic urging force of the delay member spring 151. Accordingly, as shown in FIG. 3, the first contact portion 145 contacts the detection portion 132 of the switch 131. The switch 131 outputs a signal to the outside when the first contact portion 145 contacts the detection portion 132.

In the foregoing and shown embodiment, the reset plate operates the delay member, while being pivoted centering around the pivot shaft separate from the main shaft. However, the reset plate may be configured to contact the delay member with a certain time delay, while being pivoted centering around the main shaft.

As so far described, the present invention provides a time delay output apparatus for a circuit breaker, which can simplify its construction, reduce its size and lower its manufacturing cost by excluding the use of a large size mass.

In addition, the present invention provides a time delay output apparatus for a circuit breaker which can prevent malfunction caused by reduced inertia of when a mass is vibrated or moved by electromagnetic repulsion force or external force, and can enhance operational reliability, by excluding the use of the mass.

Further, according to the present invention, even when the delay member is pivoted toward the switch by an external force, etc., the contact end portion of the reset plate and the second contact portion of the delay member may interact with each other. Accordingly, the delay member is always pivoted in a direction to contact the switch at an initial position, and after contacting the contact, the switch may always output a signal after a certain preset time delay, thus to enhance the reliability of its operation.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A time delay output apparatus for a circuit breaker, comprising:

a switch disposed at one side of a main shaft rotatable in respective directions to open/close a fixed contactor and a movable contactor;

a delay member disposed between the main shaft and the switch so as to operate the switch with a preset time delay; and a reset plate disposed to be separated from the delay member and to interact with the main shaft so as to generate the time delay, thereby transferring a driving force of the main shaft to the delay member.

2. The apparatus of claim 1, wherein the reset plate is rotatable around a pivot shaft disposed parallel to the main shaft.

3. The apparatus of claim 2, further comprising:

a delay member spring urging the delay member into contact with the switch.

4. The apparatus of claim 3, wherein the delay member comprises:

a pivot shaft;

a first contact portion extending outwardly from one side of the pivot shaft for contacting the switch; and a second contact portion extending outwardly from another side of the pivot shaft.

5. The apparatus of claim 4, further comprising:

a stopper for restricting a pivoting movement of the delay member in a direction to separate the delay member from the switch.

6. The apparatus of claim 5, wherein the delay member spring comprises a coiled tension spring.

7. The apparatus of claim 6, wherein the delay member spring has a dead point between the stopper and the switch when the delay member is pivoted.

8. The apparatus of claim 4, wherein a driving arm is disposed protruding in a radial direction at the main shaft so as to contact the reset plate.

9. The apparatus of claim 8, further comprising:

a reset plate spring urging the reset plate into contact with the driving arm.

10. The apparatus of claim 9, wherein the reset plate comprises a bent end portion bent so as to contact the delay member.

11. The apparatus of claim 10, wherein when the main shaft is rotated to a trip position, the reset plate presses the second contact portion whereby the delay member is pivoted, and when the main shaft is rotated in a direction to contact the fixed contactor with the movable contactor, the reset plate presses the first contact portion whereby the delay member is pivoted.

12. The apparatus of claim 10, wherein the bent end portion contacts the delay member and restricts the pivoting movement of the delay member when the delay member is suddenly rotated.

13. The apparatus of claim 12, wherein, when the bent end portion and the delay member contact each other, when the main shaft is rotated at the time of a closing operation, the bent end portion presses the second contact portion and the reset plate is pivoted in a direction to separate the delay member from the switch, and the reset plate presses the second contact portion whereby the second contact portion contacts the switch.

14. The apparatus of claim 1, wherein the delay member operates the switch after the fixed contactor and the movable contactor contact each other.

15. A time delay output apparatus for a circuit breaker, comprising:

a switch disposed at one side of a main shaft rotatable in directions to open/close a fixed contactor and a movable contactor;

a delay member disposed between the main shaft and the switch so as to operate the switch with a preset time delay;

a delay member spring urging the delay member into contact with the switch; and a reset plate disposed to be separated from the delay member and to interwork with the main shaft so as to generate the time delay, to thereby transfer a driving force of the main shaft to the delay member.

16. The apparatus of claim 15, wherein the reset plate is rotatable centering around a pivot shaft disposed parallel to the main shaft.

17. The apparatus of claim 16, further comprising:

a reset plate spring urging the reset plate into contact with the main shaft.

* * * * *